US007774992B2

(12) United States Patent
Garofalo et al.

(10) Patent No.: US 7,774,992 B2
(45) Date of Patent: Aug. 17, 2010

(54) TILE AND STRUT CONSTRUCTION SYSTEM FOR GEODESIC DOME

(76) Inventors: James C. Garofalo, P.O. Box 287, Hadley, NY (US) 12835; James W. Garofalo, P.O. Box 287, Hadley, NY (US) 12835

( * ) Notice: Subject to any disclaimer, the term of this patent is extended or adjusted under 35 U.S.C. 154(b) by 331 days.

(21) Appl. No.: 11/879,582

(22) Filed: Jul. 18, 2007

(65) Prior Publication Data

US 2009/0019790 A1 Jan. 22, 2009

(51) Int. Cl.
*E04B 7/08* (2006.01)

(52) U.S. Cl. ..... 52/81.3; 52/81.1; 52/81.4

(58) Field of Classification Search ..... 52/80.1–81.5, 52/200

See application file for complete search history.

(56) References Cited

U.S. PATENT DOCUMENTS

| | | | | | |
|---|---|---|---|---|---|
| 2,820,990 | A | | 1/1958 | Johnson | |
| 2,864,132 | A | | 12/1958 | Clements | |
| 3,665,661 | A | * | 5/1972 | Beckerer | 52/19 |
| 3,744,205 | A | * | 7/1973 | Moss | 52/745.08 |
| 3,807,101 | A | * | 4/1974 | Cole | 52/11 |
| 3,857,212 | A | * | 12/1974 | Barnett | 52/81.3 |
| 3,919,813 | A | | 11/1975 | Beindorf | |
| 3,983,669 | A | * | 10/1976 | Bogaert | 52/200 |
| 4,009,543 | A | * | 3/1977 | Smrt | 52/81.2 |
| 4,023,317 | A | | 5/1977 | Bettger et al. | |
| 4,149,346 | A | | 4/1979 | Belt | |
| 4,297,814 | A | | 11/1981 | Tomassetti, Jr. et al. | |
| 4,309,852 | A | * | 1/1982 | Stolpin | 52/81.3 |
| 4,330,969 | A | | 5/1982 | Quaney | |
| 4,440,376 | A | | 4/1984 | Peterson | |
| 4,603,519 | A | * | 8/1986 | Lew et al. | 52/81.2 |
| 4,611,441 | A | * | 9/1986 | Wickens | 52/81.4 |
| 4,625,472 | A | | 12/1986 | Busick | |
| 4,642,952 | A | | 2/1987 | Prandin | |
| 4,665,665 | A | | 5/1987 | Wilkinson | |
| 4,686,804 | A | | 8/1987 | Smith | |
| 4,736,551 | A | * | 4/1988 | Higson | 52/81.4 |
| 5,452,555 | A | * | 9/1995 | Lee | 52/584.1 |
| 5,706,624 | A | | 1/1998 | Lipson | |
| 5,732,518 | A | * | 3/1998 | Roberts | 52/245 |
| 6,098,347 | A | | 8/2000 | Jaeger et al. | |
| 6,134,849 | A | * | 10/2000 | Holler | 52/80.1 |
| 6,658,800 | B2 | | 12/2003 | Monson et al. | |
| 7,228,671 | B1 | * | 6/2007 | McCarten | 52/653.1 |
| 2005/0022461 | A1 | | 2/2005 | Geiger | |
| 2008/0066393 | A1 | * | 3/2008 | Sorensen | 52/81.1 |
| 2008/0209821 | A1 | * | 9/2008 | Nefzi | 52/81.4 |

* cited by examiner

*Primary Examiner*—Richard E Chilcot, Jr.
*Assistant Examiner*—Elizabeth A Plummer
(74) *Attorney, Agent, or Firm*—Cantor Colburn LLP

(57) ABSTRACT

The present invention sets forth a tile and strut construction system for a geodesic dome. The tile has a generally triangular shape, with the corners cut out to accommodate hubs which retain supporting struts in position. The tile has a faceted 3-dimensional upper surface, integrally molded reinforcing ribs, a recess in the lower surface at each of its 3 edges.

10 Claims, 2 Drawing Sheets

TILE AND STRUT CONSTRUCTION SYSTEM FOR GEODESIC DOME

BACKGROUND OF THE INVENTION

1. Field of the Invention

The present invention relates generally to geodesic domes, and more specifically to a prefabricated plastic tile and a strut designed for use together to create a strong, yet easy-to-assemble, geodesic dome.

2. Background of the Invention

Structures in the form of geodesic domes have been being built since their invention by Buckminster Fuller in the 1950's, however their construction, until now, has involved a complicated and difficult procedure. A geodesic dome comprises a configuration of repeating geometric shapes, such as triangles, which form the dome's surface. The architecture of the dome structure is typically a series of struts which link to hubs to create the dome's framework. The area, or space, created between any three contiguous struts, i.e. the area of the triangles formed by these repeated struts and hubs, must necessarily be sub-divided, enclosed, and covered, as they are of a sizable dimension which is interdependent with the diameter of the dome itself.

In some prior art domes, a plurality of geometric tiles are secured together to form a three-dimensional geometric shape, which is assembled with other such secured-together three-dimensional geometric shapes in order to form the dome. This method of assembly is arduous and inefficient.

One prior art method of constructing geodesic domes involves manipulating polygonal panels of the dome so that they slide into lateral pockets formed on each side of a generally I-beam shaped strut. Such manipulation may not be difficult when inserting a first side of the panel, but once a first side is locked into place, it appears impractical, if not impossible, to angle and manipulate subsequent sides of the panel into place within the pockets of other struts.

Some prior art panels for geodesic domes are manufactured in layers, with inner and outer faces secured to intermediate support structure. Such a manufacturing method is more complicated and costly than desired.

In some prior art domes, in order to finish the interior of the dome after assembling the outer structure, panels of sheetrock or some other finishing material must be individually and precisely cut to fit the unique shape of each geometric section of the dome, and then taped and painted. This is a very time consuming and difficult process.

Prior art geodesic domes are manufactured by a process that involves many steps, and includes a complex structure to attach adjacent tiles to the struts that support them. The tiles of the prior art are not designed for, nor capable of, supporting significant amounts of weight, as would be necessary if the dome is to be earth-sheltered.

It is known that earth-sheltering a structure provides advantages in the energy needs for heating and cooling that structure. In order to be earth-sheltered, a structure must be capable of supporting the significant weight of the dirt located above the structure. Prior art panels and systems for building geodesic domes are not designed to bear such heavy loads.

There is a need in the art for a strong, lightweight preformed, easy-to-manufacture tile designed to support a significant amount of weight. There is a need for the tile and the struts which support it to be capable of being assembled to form a geodesic dome quickly and easily, with a minimal amount of skill and tools required. In addition, the tile should either be provided with an interior surface that is manufactured as a finished surface, or have a system that enables a finished surface to be quickly and easily attached thereto.

SUMMARY OF THE INVENTION

The present invention sets forth a tile for use in building a geodesic dome. The tile is a preformed plastic panel having a polygonal, typically triangular, footprint. The superior surface of the panel has a non-planar, three-dimensional surface, formed with planar surfaces extending up at an angle from respective side edges of the panel until they meet at a high point at the geometric center of the panel. The inferior surface of the panel includes a recessed portion extending along at least a portion of each side edge of the panel.

The panel may also include any combination of a variety of additional features, including beveled side edges, internally located molded reinforcing ribs for increased strength, an embedded reinforcing member of steel or some other suitable material, a flange extending outwardly from the upper surface of the panel at each of its side edges, and cut-away portions where each of two adjacent sides of the panel meet to accommodate a hub that joins supporting struts of the geodesic dome. Further, the underside of the panel may either comprise a finished interior surface, molded integrally with the rest of the tile, or the underside could comprise a separate sheet of finishing material sized and shaped to cover the exposed molded reinforcing ribs and including connecting structure on the separate sheet of finishing material and on the underside of the rest of the panel, whereby the separate sheet can snap into place on the underside of the panel to quickly and easily provide a finished interior surface of the dome.

The present invention further sets forth a strut for use with the inventive tile. A first configuration of the strut has a cross-section in the shape of an I-beam, with an L-shaped bracket seated upon a portion of the length of the lower lateral member of the "I", such that one leg of the bracket rests along the vertical central member of the "I", and the other leg of the bracket rests along and extends beyond the lower lateral member of the "I". A second configuration of the strut has a cross-section substantially in the shape of an inverted "T", with the two lateral legs of the "T" forming an obtuse angle with the longer, vertical leg of the "T".

In use, once the framework for a geodesic dome is built, by connecting together a series of the inventive struts using a plurality of hubs which support the struts at their respective free ends to thereby create polygonal openings bound by a plurality of struts and hubs, the size and shape of the polygonal openings corresponding to the size and shape of the inventive tiles, the tiles of the invention are dropped into respective openings in the framework and secured thereto.

It is therefore an object of the invention to provide a tile for use in building a geodesic dome, wherein the tile is easy to manufacture and light weight, yet strong enough to support substantial loads.

It is another object of the invention to provide a strut which can, when linked together with additional struts, provide a bound opening designed to easily receive and securely support a tile of the invention thereon.

It is a further object of the invention to provide a strut and tile system, wherein once the struts are assembled to form a dome structure, the tiles can quickly and easily be dropped into openings bound by the assembled struts, and be secured to the struts.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
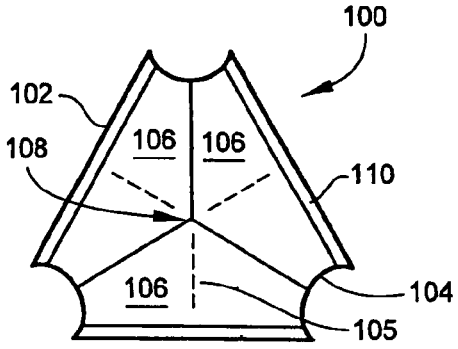
FIG. 1 is a top view of a first embodiment of the tile of the invention.

FIGS. 1 to 4 depict a first embodiment of the tile and strut construction system of the invention. FIG. 1 shows a top view of a tile 100 of the first embodiment. As viewed from above, the tile 100 is substantially triangular in shape, with three side edges 102. Where each of the points of the triangle of the tile 100 would be, a small section is cut away leaving a curved free edge 104 whose purpose is to accommodate, during assembly of a geodesic dome, a rounded hub (not shown) that receives and supports a free end of the struts 200 which will serve to support and constrain the tile 100 of the invention when it is used to build a geodesic dome, as discussed further below. The upper surface of the tile 100 is three-dimensional, formed by three triangular portions 106, with each portion having a lower, base side formed by a respective side edge 102 of the tile 100, the triangular portions 106 each being angled upward until the upper corners meet together at a point 108 located at the center of the tile 100, as viewed from above, giving the upper surface of the tile 100 the appearance of a three-faceted diamond. Because the tile and strut construction system is intended to build a geodesic dome that is earth-sheltered, this faceted shape of the upper surface of the tile 100 is important because it serves to deflect the weight of earth resting upon the tiles 100 away from the less supported center 108 of each tile 100 and towards the side edges 102 thereof, where the tile 100 is supported by struts 200. While the tile 100 is being discussed in terms of a triangular shape, it is understood that the tile can be formed in any suitable polygonal shape.

Figure 2:
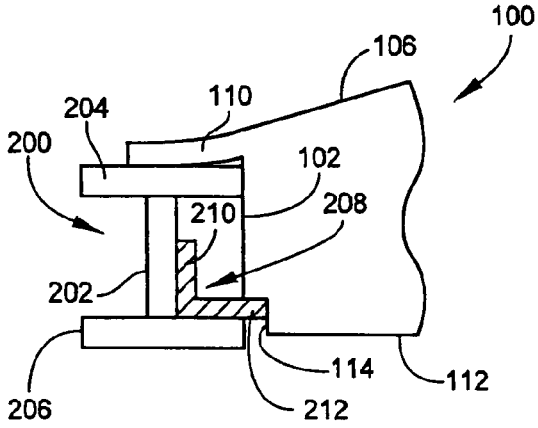
FIG. 2 is a cross-sectional side view of the tile of FIG. 1 in combination with a first embodiment of the strut of the invention.

FIG. 2 shows a cross-sectional side view of a portion of the tile 100 of the invention in combination with a strut 200 of the invention. The tile 100 can be seen to include triangular portion 106 forming the superior surface of the tile 100, with a flange 110 extending beyond the side edge 102 of the tile 100 at the superior surface of the tile 100. Cut into the corner where the side edge 102 and the inferior surface 112 of the tile 100 meet is a recess 114 that extends along a portion of the length of the side edge 102. The lower portion of each side edge 102 includes such a recess 114, whose purpose will be discussed shortly.

The strut 200 shown in FIG. 2 can be seen to include an I-beam having a vertical central member 202, an upper lateral member 204 and a lower lateral member 206. The upper and lower lateral members 204, 206 serve as nailers, meaning that they are capable of receiving fasteners therein. If they are not made of a material, such as wood or plastic, that is soft enough to be nailed or screwed into directly, then the lateral members could have predrilled holes located at intervals along their length. This enables tile 100 which is supported by strut 200 to be securely attached thereto by means of a fastener. Strut 200 further includes an L-bracket 208 having a first leg 210 that extends along vertical central member 202 of the I-beam, and a second leg 212 that rests upon and extends beyond lower lateral member 206 of the I-beam. The L-bracket is made of a strong material, such as metal or a very strong plastic, which is capable of supporting significant weight thereon. In use, once a series of struts 200 and hubs (not shown) are assembled to provide the framework for a geodesic dome, with adjacent struts 200 and hubs together forming a substantially triangular opening, the tile 100 of the invention is dropped down within the opening. The recesses 114 on each of the edges 102 of the lower surface 112 of the tile 100 receive the L-bracket 208 of the strut, whereby the L-brackets 208 support the weight of the tile 100, and each of the flanges 110 extending from the upper surface beyond side edges 102 of the tile 100 extend over and seal against the top of upper lateral member 204 of their respective struts 200. The inferior surface 112 of tile 100 can be seen to extend below a lower surface of second leg 212 of L-bracket 208, but not so far down as to be flush with the lower surface of lower lateral member 206 of strut 200. This allows for a separate finishing sheet to be attached thereto, as will be discussed further below.

Figure 3:
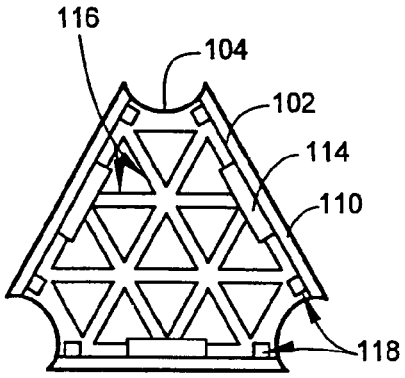
FIG. 3 is a bottom view of the tile of FIG. 1.

As seen in FIG. 3, a series of reinforcement ribs 116 can be molded in unitary fashion into the cavity formed by triangular portions 106 and side edges 102 of the tile 100. These ribs 116 add strength to the tile 100 while minimizing its weight. The size, number, shape, and arrangement of the ribs 116 shown in the drawings are to be considered merely illustrative. Any size, number, shape, and arrangement of the ribs determined to be desirable are considered to be within the scope of the invention. To further enhance the strength of the tile 100, the tile 100 may optionally be reinforced by the inclusion of elements of a stronger material, such as by the inclusion of steel re-bars 105, as seen in phantom in FIG. 1.

Figure 3A:
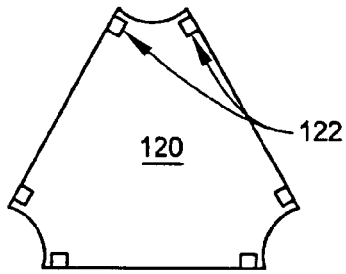
FIG. 3A is a top view of a separate sheet of finishing material for attachment to the underside of the tile of FIG. 1.
Figure 4:
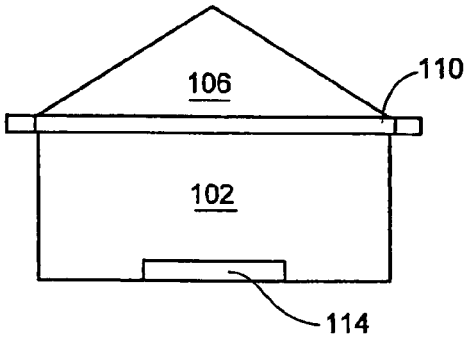
FIG. 4 is a side view of the tile of FIG. 1.

It is desirable for the interior surface of the dome to be a smooth, finished surface that is aesthetically pleasing. As seen in FIG. 3A, a separate sheet of finishing material 120 sized and shaped to cover the underside of the tile 100 is provided with a plurality of first structural elements 122 located on a superior surface thereof. These first structural elements 122 are designed to mate with corresponding second structural elements 118 positioned in corresponding locations on the underside of tile 100, whereby positioning of separate sheet 120 against the underside of tile 100 such that first structural elements 122 mate with second structural elements 118 causes separate sheet 120 to quickly and easily be secured to the underside of the tile 100, thereby providing an aesthetically pleasing finished interior on the dome. It is understood that the number and location of structural elements 118, 122 shown in the drawing are merely illustrative in nature, and that any suitable number and location of such structural elements is considered to be within the scope of the invention. Similarly, any type of mating structural elements 118, 122 that will enable the separate sheet of finishing material 120 to be securely fastened to the underside of tile 100 is considered to be within the scope of the invention.

If a builder prefers to provide some other form of finished surface, they need merely forego use of the separate sheet of finishing material 120 and attach whatever other form of finishing is desired, such as drywall or paneling, to the underside of the tile 100. This is not difficult to do because the tile 100 of the invention may be screwed or nailed into.

In use, a framework for a geodesic dome will be constructed by taking a plurality of the struts 200 of the invention and supporting them at their free ends using hubs (not shown), with each hub typically supporting 4, 5, or 6 struts 200, whereby the struts and hubs together form a series of substantially triangular openings all over the framework of the dome. A tile 100 of the invention is dropped into each of the substantially triangular openings with the flanges 110 of each tile 100 sealing to an upper surface of the adjacent struts 200 and the weight of each tile 100 being supported by the L-brackets 208 on the adjacent struts 200. Each tile 100 is then secured to its adjacent struts 200 using a plurality of fasteners, such as nails or screws, through the lateral members of the struts 200. The interior surface of the dome will be finished, either by securing the separate sheet of finishing material 120 to the underside of the tile 100 using the structural elements 118, 122 provided, or by securing an alternative finishing material to the underside of each tile using an alternative means of fastening, such as screws.

Figure 5:
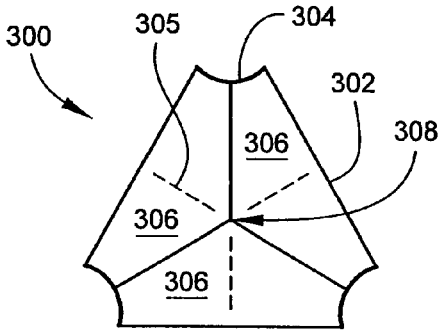
FIG. 5 is a top view of a second embodiment of the tile of the invention.

A second embodiment of the tile and strut construction system of the invention is seen in FIGS. 5 to 10. FIG. 5 shows a top view of a tile 300 of the second embodiment of the invention. As viewed from above, the tile 300 is substantially triangular in shape, with three side edges 302. Where each of the points of the triangle of the tile 300 would be, a small section is cut away leaving a curved free edge 304 whose purpose is to accommodate, during assembly of a geodesic dome, a rounded hub (not shown) that receives a free end of the struts 400 which will serve to support and constrain the tile 300 of the invention when it is used to build a geodesic dome, as discussed further below. The upper surface of the tile is three-dimensional, formed by three triangular portions 306, with each portion having a lower, base side formed by a respective side edge 302 of the tile 300, the triangular portions 306 each being angled upward until the upper corners meet together at a point 308 located at the center of the tile 300, as viewed from above, giving the upper surface of the tile 300 the appearance of a three-faceted diamond. While the tile 300 is being discussed in terms of a triangular shape, it is understood that the tile can be formed in any suitable polygonal shape.

Figure 6:
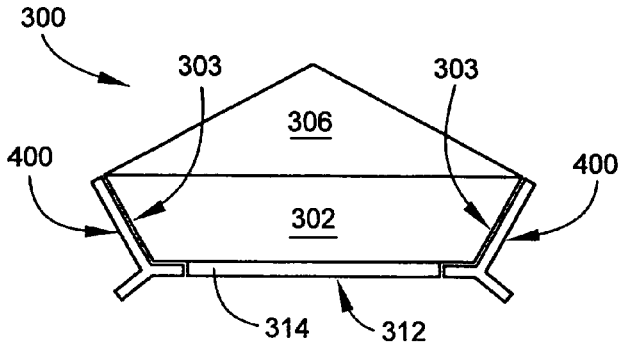
FIG. 6 is a side view of the tile of FIG. 5 in combination with a second embodiment of the strut of the invention.

FIG. 6 shows a side view of the tile 300 of the invention in combination with two struts 400 of the invention. The tile 300 can be seen to include triangular portion 306 forming the superior surface of the tile 300. Cut into the corner where the side edge 302 and the inferior surface 312 of the tile 300 meet is a recess 314 that extends along the full length of the side edge 302. The lower portion of each side edge 302 includes such a recess 314, whose purpose will be discussed shortly. The side edges 302 of tile 300 can be seen to be beveled 303, being wider at the top than at the bottom. This beveling facilitates the mating of the tiles 300 with adjacent struts 400 at the appropriate angle necessary for formation of the dome.

Figure 7:
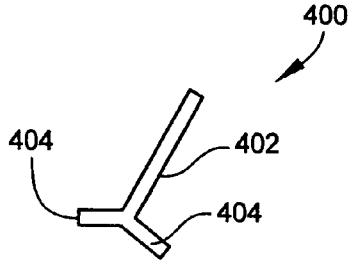
FIG. 7 is a cross-sectional side view of the strut of FIG. 6.

FIG. 7 shows a side edge view of strut 400, whose cross-section is substantially in the shape of an inverted "T", with two lateral legs 404 each forming an obtuse angle with the longer, vertical leg 402 of the "T", the obtuse angle typically being less than 100 degrees. While each of the lateral legs 404 is shown in this Figure to form identical obtuse angles with vertical leg 402, this is not necessarily the case. It is possible that each of the lateral legs 404 in strut 400 form a different obtuse angle with vertical leg 402 from the obtuse angle formed by the other lateral leg 404. As seen in FIG. 6, each of the recesses 314 of the tile 300 receives one of the lateral legs 404 of an adjacent strut 400, whereby the inferior surface 312 of tile 300 extends down below the recess 314 to be flush with a lower surface of lateral leg 404 of strut 400. The strut 400 of this embodiment would be made of any suitable material that is strong enough to support tiles 300 thereon, including, but not limited to steel. Additionally, because the tile 300 to be used with strut 400 is molded of plastic, it is possible, rather than having the lateral legs 404 form an obtuse angle with vertical leg 402, to have lateral legs 404 made to form a right angle with vertical leg 402, with tile 300 formed to compensate by changing the angle of the bevel 303 and the recess 314.

Figure 8:
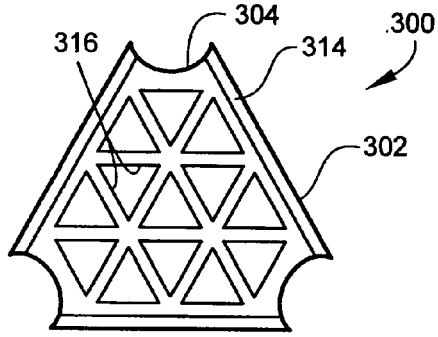
FIG. 8 is a cross-sectional view from below of the tile of FIG. 6.

As seen in FIG. 8, a series of reinforcement ribs 316 can be molded in unitary fashion into the cavity formed by triangular portions 306 and side edges 302 of the tile 300. These ribs add strength to the tile while minimizing its weight. The size, number, shape, and arrangement of the ribs shown in the drawings are to be considered merely illustrative. Any size, number, shape, and arrangement of the ribs determined to be desirable are considered to be within the scope of the invention. To further enhance the strength of the tile 300, the tile 300 may optionally be reinforced by the inclusion of elements of a stronger material, such as by the inclusion of steel re-bars 305, as seen in phantom in FIG. 5.

Figure 9:
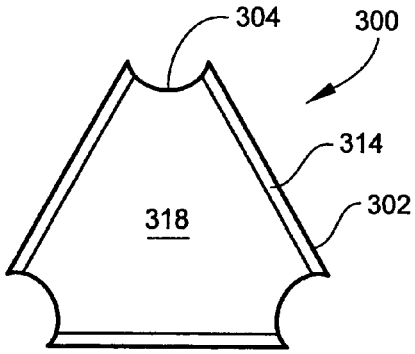
FIG. 9 is a bottom view of the tile of FIG. 6.

FIG. 9 shows a bottom view of the tile 300. It can be seen that this embodiment may me manufactured to include a molded, unitary solid lower finished surface 313 which would be flush with a lower surface of lateral legs 404 of the struts 400 supporting it, whereby upon assembly of the tiles 300 to the struts 400 to form a dome (not shown), the interior surface of the dome would have a smooth, finished surface, eliminating the need to cut and fashion sheetrock or some other finishing material to each of the individual panels of the completed dome. In the alternative, as is done in the first embodiment, the lower surface 318 may be manufactured in the form of a separate sheet of finishing material sized and shaped to mate with the underside of tile 300, the separate sheet of finishing material including structural elements that cooperate with mating structural elements on the underside of tile 300 to allow the separate sheet of finishing material to quickly and easily attach to the underside of the tile 300, preferably by snapping into place thereon.

Figure 10:
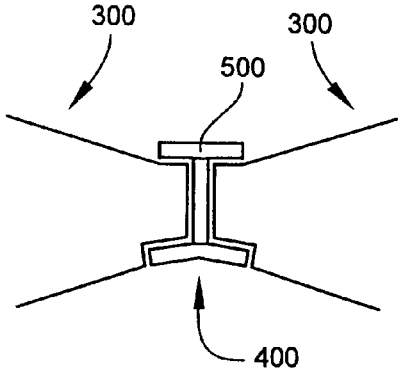
FIG. 10 is a cross-sectional side view of a portion of two of the tiles of FIG. 6 in combination with the strut of FIG. 6, as well as a sealing strip.

FIG. 10 shows a cross-sectional side view of strut 400 with two tiles 300 supported thereby. Because the tile 300 of the second embodiment does not have an upper flange to form a seal with the adjacent strut 400 (as the tile 100 of the first embodiment does), after assembly of the tiles 300 on opposing sides of a strut 400, a sealing strip 500, typically made of plastic, would be placed over the seams of the tiles 300 and the strut 400. The sealing strip 500 could attach to the tiles 300 themselves, and/or to the exposed end of vertical leg 402 of strut 400.

In use, a framework for a geodesic dome will be constructed by taking a plurality of the struts 400 of the invention and supporting them at their free ends using hubs (not shown), with each hub typically supporting 4, 5, or 6 struts 400, whereby the struts and hubs together form a series of substantially triangular openings all over the framework of the dome. A tile 300 of the invention is dropped into each of the substantially triangular openings with each lateral leg 404 of each strut 400 being received within a respective recess 314 of the tile, with the weight of each tile 300 being supported by the lateral legs 404 of the adjacent struts 400. Each tile 300 is then secured to its adjacent struts 400 using a plurality of fasteners, such as nails or screws, through the lateral members of the struts 400. If the tile 300 includes an integrally molded smooth finishing surface on its underside, then no further finishing work need be done. If the tile 300 does not include an integrally molded smooth finishing surface on its underside, then the interior surface of the dome will be finished, either by securing the separate sheet of finishing material to the underside of the tile 100 using mating structural elements provided, or by securing an alternative finishing material to the underside of each tile using an alternative means of fastening, such as screws.

It is to be understood that the present invention is not limited to the embodiments described above, but encompasses any and all embodiments within the scope of the following claims.

What is claimed is:

1. A system for use in constructing a geodesic dome, said system comprising:

a strut, said strut comprising:

an elongate vertical central member having an upper edge and a lower edge, two side edges, a first substantially planar side, and a second substantially planar side, an elongate first lower lateral leg extending along and projecting from the entire lower edge of said central member on said first substantially planar side, said elongate first lower lateral leg forming a first obtuse angle with said elongate vertical central member, an elongate second lower lateral leg extending along and projecting from the entire lower edge of said central member on said second substantially planar side, said elongate second lower lateral leg forming a second obtuse angle with said elongate vertical central member; and a tile, said tile comprising:

a preformed plastic panel having a substantially polygonal shape having a predetermined number of side edges, said panel having:

a superior surface having a non-planar, three-dimensional surface formed with planar surfaces extending up at an angle from respective side edges of the panel until they meet at a high point at the center of the panel;

a plurality of side walls corresponding in number to said predetermined number side edges, said side walls depending from said superior surface, and each of said side walls having a recess formed therein along at least a portion of a lower edge thereof, each of said recesses sized and shaped to receive one of said lower lateral legs of said strut;

said side walls, together with said superior surface, forming an interior cavity; and an inferior surface;

wherein when said tile is seated upon said strut with one of said lower lateral legs of said strut received said recess in one of said side walls of said tile, said superior surface of said tile is located adjacent said upper edge of said elongate vertical central member of said strut.

2. A system for use in constructing a geodesic dome, as defined in claim 1, said system further comprising a sealing strip sized and shaped to have a length sufficient to extend along substantially the full length of the strut and a width sufficient to extend across an upper surface of said upper edge of said elongate vertical central member with a portion of said sealing strip extending onto a portion of the superior surface of tiles received on each side of said strut, to thereby seal joints formed between a strut and two tiles which it supports.

3. A system for use in constructing a geodesic dome, as defined in claim 1, wherein said first obtuse angle and said second obtuse angle are the same as one another.

4. A system for use in constructing a geodesic dome, as defined in claim 1, wherein said first obtuse angle and said second obtuse angle are different from one another.

5. A tile, as defined in claim 1, wherein said panel further includes at each of the corners where two sides of said polygonal shape meet, a cut-away portion sized and shaped for accommodating a strut-retaining hub of a frame of a geodesic dome.

6. A tile, as defined in claim 1, wherein said panel further includes a plurality of reinforcement ribs located within said cavity and formed unitarily with the material of said superior surface and side walls.

7. A tile, as defined in claim 1, wherein said side walls are beveled, such that, when viewed from the side, the side walls are each wider at the top than at the bottom.

8. A tile, as defined in claim 1, wherein said inferior surface comprises a smooth, solid finished surface unitarily formed with the remainder of said panel.

9. A tile, as defined in claim 1, wherein said inferior surface is covered by a separate sheet of finishing material, said separate sheet comprising an upper surface, a lower surface having a desirable finish, and side edges, said separate sheet having a size and shape whereby said side edges of said separate sheet correspond with said side walls of said tile;

said upper surface of said separate sheet having a plurality of first structural elements located thereon;

said inferior surface of said panel having a plurality of second structural elements located thereon;

each of said plurality of first structural elements being located in a corresponding position a respective one of said plurality of second structural elements and being designed to mate therewith, whereby placing said separate sheet of finishing material against said inferior surface of said tile enables said plurality of first structural elements to mate with said plurality of second structural elements to thereby retain said separate sheet of finishing material in position under the tile to provide a desirable finish on the underside of the tile.

10. A system for use in constructing a geodesic dome, said system comprising:

a strut, said strut comprising:

an elongate beam whose cross-section is an "I" shape, the beam having a vertical central member, an upper lateral member extending across the top of and at a right angle to said vertical central member, a lower lateral member extending across the bottom of and at a right angle to said vertical central member, an elongate bracket extending along at least a portion of the length of the beam, the cross-section of the bracket being an "L" shape, with a first leg of said bracket extending along said vertical central member of the beam and a second leg of said bracket resting upon and extending along and beyond said lower lateral member of the beam, said elongate bracket having a length; and a tile, said tile comprising:

a preformed plastic panel having a substantially polygonal shape having a predetermined number of side edges, said panel having:

a superior surface having a non-planar, three-dimensional surface formed with planar surfaces extending up at an angle from respective side edges of the panel until they meet at a high point at the center of the panel;

a plurality of side walls corresponding in number to said predetermined number side edges, said side walls depending from said superior surface, and each of said side walls having a recess formed therein along a portion of a lower edge thereof, each said recess having a length corresponding to said length of said elongate bracket;

a flange extending from said superior surface on each of the side edges of the panel, said flange extending beyond each of said side walls of said tile;

said side walls, together with said superior surface, forming an interior cavity; and an inferior surface;

wherein when said tile is seated upon said strut with said elongate bracket received within said recess in one of said side walls of said tile, said flange extending from said superior surface of said tile and extending beyond said one of said side walls is seated against a portion of said upper edge of said elongate vertical central member of said strut.

* * * * *